US010101004B1

(12) United States Patent
Turcotte et al.

(10) Patent No.: US 10,101,004 B1
(45) Date of Patent: Oct. 16, 2018

(54) LIGHT COVE CAP

(71) Applicant: Dorr Houzzer USA LLC, Pompano Beach, FL (US)

(72) Inventors: Mario Turcotte, Pompano Beach, FL (US); Richard Mayo, Lake Worth, FL (US)

(73) Assignee: Dorr Houzzer USA LLC, Pompano Beach, FL (US)

( * ) Notice: Subject to any disclaimer, the term of this patent is extended or adjusted under 35 U.S.C. 154(b) by 0 days.

(21) Appl. No.: 15/833,207

(22) Filed: Dec. 6, 2017

(51) Int. Cl.

| | |
|---|---|
| ***F21V 21/02*** | (2006.01) |
| ***F21S 8/00*** | (2006.01) |
| ***F21V 7/00*** | (2006.01) |
| ***F21S 8/04*** | (2006.01) |

(52) U.S. Cl.
CPC ..... *F21V 7/0008* (2013.01); *F21S 8/04* (2013.01)

(58) Field of Classification Search
CPC ... F21V 21/02; F21S 8/033; F21S 8/00; F21S 33/006
USPC ..... 362/145, 147
See application file for complete search history.

(56) References Cited

U.S. PATENT DOCUMENTS

| | | | | |
|---|---|---|---|---|
| 2007/0081325 | A1* | 4/2007 | Shwisha | F21S 8/033 362/145 |
| 2009/0129093 | A1* | 5/2009 | Wittig | F21V 7/005 362/297 |
| 2013/0314907 | A1* | 11/2013 | Swisha | F21V 21/02 362/147 |
| 2017/0023156 | A1* | 1/2017 | Hoffman | E04F 19/04 |
| 2017/0082252 | A1* | 3/2017 | Casement | F21S 8/026 |
| 2017/0343194 | A1* | 11/2017 | Campbell | F21S 8/037 |
| 2018/0031189 | A1* | 2/2018 | Pearson | F21S 2/005 |

OTHER PUBLICATIONS

Wayback machine archive Gordon Interior Specialties Division, Light Cove Profiles, https://web.archive.org/web/20160803004931/http:/www.gordon-inc.com/interiors/lightcove/profiles.aspx, Web. Aug. 3, 2016, pp. 1-5.

* cited by examiner

*Primary Examiner* — Daniel A Hess
(74) *Attorney, Agent, or Firm* — Scott Watkins

(57) ABSTRACT

A light cove cap is provided. The cap includes: a first wall; an second wall extending from the first wall; a third wall extending from the first wall below the second wall and substantially parallel to the first wall; the second wall, the third wall, and a bridging portion of the first wall defining a board receiving area; the first wall extending below the third wall, wherein the third wall and portion of the first wall extending below the third wall defines a drywall compound receiving area.

18 Claims, 20 Drawing Sheets

LIGHT COVE CAP

FIELD OF THE INVENTION

The instant application relates to a light cove cap. More specifically, the instant application relates to a cap for a light cove that defines an end to the light cove and is easy to install.

BACKGROUND

Cove lighting is a lighting technique that directs light toward the ceiling from one or more sides of a room to diffuse illumination. This effect is also called ambient luminescence. Cove lighting is found in ledges, recesses, ceiling valences and high on walls. This type of indoor lighting is popular because it hides the fixture and creates a dramatic effect. The light of this technique can be directed either up toward the ceiling or down creating a wall washing effect. Applications of cove lighting can be found in residential and commercial settings. In residential settings, cove lighting is often used above cabinets in the kitchen.

FIG. 1 shows an example of a prior art light cove relative to a ceiling 102 and a wall 104. A board 106, such as drywall or gypsum board, extends horizontally from wall 104. Another piece of board 108 is mounted at the end of the horizontal board, and acts as a light boundary. A light source 110 is mounted on the horizontal board 106 and illuminates upward toward the ceiling 102 and light 112 emerges from the gap between the top of the vertical board 108 and the ceiling 102.

FIG. 2 shows another example of prior art light cove, in which the light cove is suspended from ceiling 102 by one or more supports 120 rather than wall 104.

The prior art design of FIGS. 1 and 2 are labor intensive to install, as the ends of the horizontal and vertical boards must be framed. Using typical drywall joining techniques, the corners will be joined by drywall joining compound (referred to herein as "mud") and/or drywall tape to form the overall surface and painted over to provide an overall uniform aesthetic. Corners at the end of boards formed by mud and tape are rounded and the design has an uneven visual aesthetic, which is undesirable home décor styles, such as modern, that are based on clean, sharp lines.

BRIEF DESCRIPTION OF THE DRAWINGS

Various embodiments in accordance with the present disclosure will be described with reference to the drawings, in which.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. An individual skilled in the relevant art will recognize that other caps and configurations may be used without departing from the scope and spirit of the claimed subject matter.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. Substantially "parallel" "perpendicular" or the like are preferably within about 5-10 degrees of ideal. Distances or sizes referred to as "substantially the same" or the like are less than about ±5%, preferably less than about ±3%, particularly less than 0.01 inch variation, and most particularly identical to thousands of an inch scale.

The term "comprising" when utilized, means "including, but not necessarily limited to"; it specifically indicates open-ended inclusion or membership in the so-described combination, group, series and the like. The term "a" means "one or more" absent express indication that it is limited to the singular. "First," "second," etc., are labels to differentiate like terms from each other, and does not imply any order or numerical limitation.

The terms used herein such as "horizontal" "vertical," "diagonal," "top," "bottom," "upper," "lower" and the like are to provide a frame of reference for portions of the embodiments to be described relative to each other, and not to absolute space. For example, a surface may be described as horizontal so another surface can be described as diagonal or vertical relative thereto. However, such frames of reference do not limit the scope of the invention, e.g., rotating cap to a different orientation does not change the special relationship.

Figure 3:
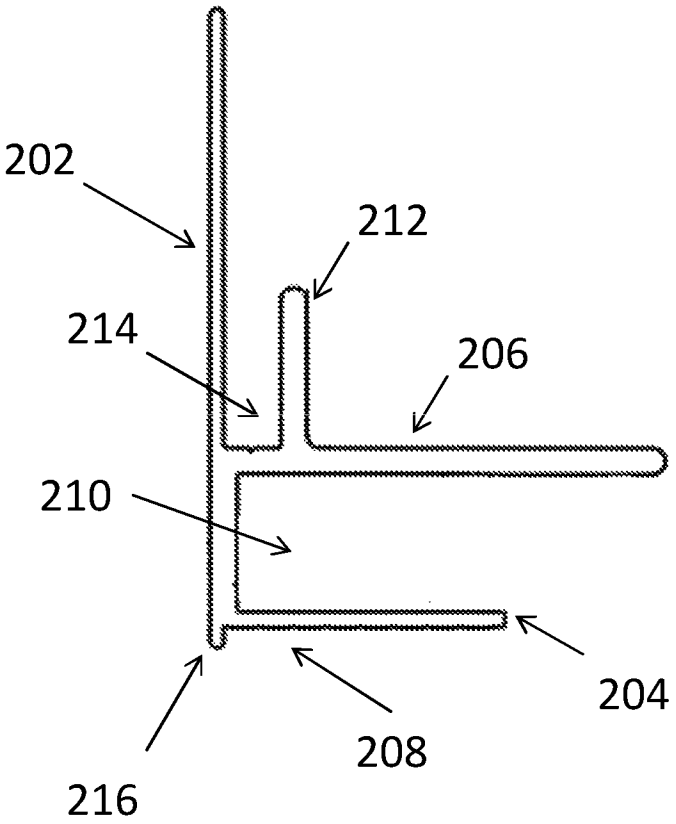
FIG. 3 is a cross section of a light cove cap according to an embodiment of the invention.
Figure 4:
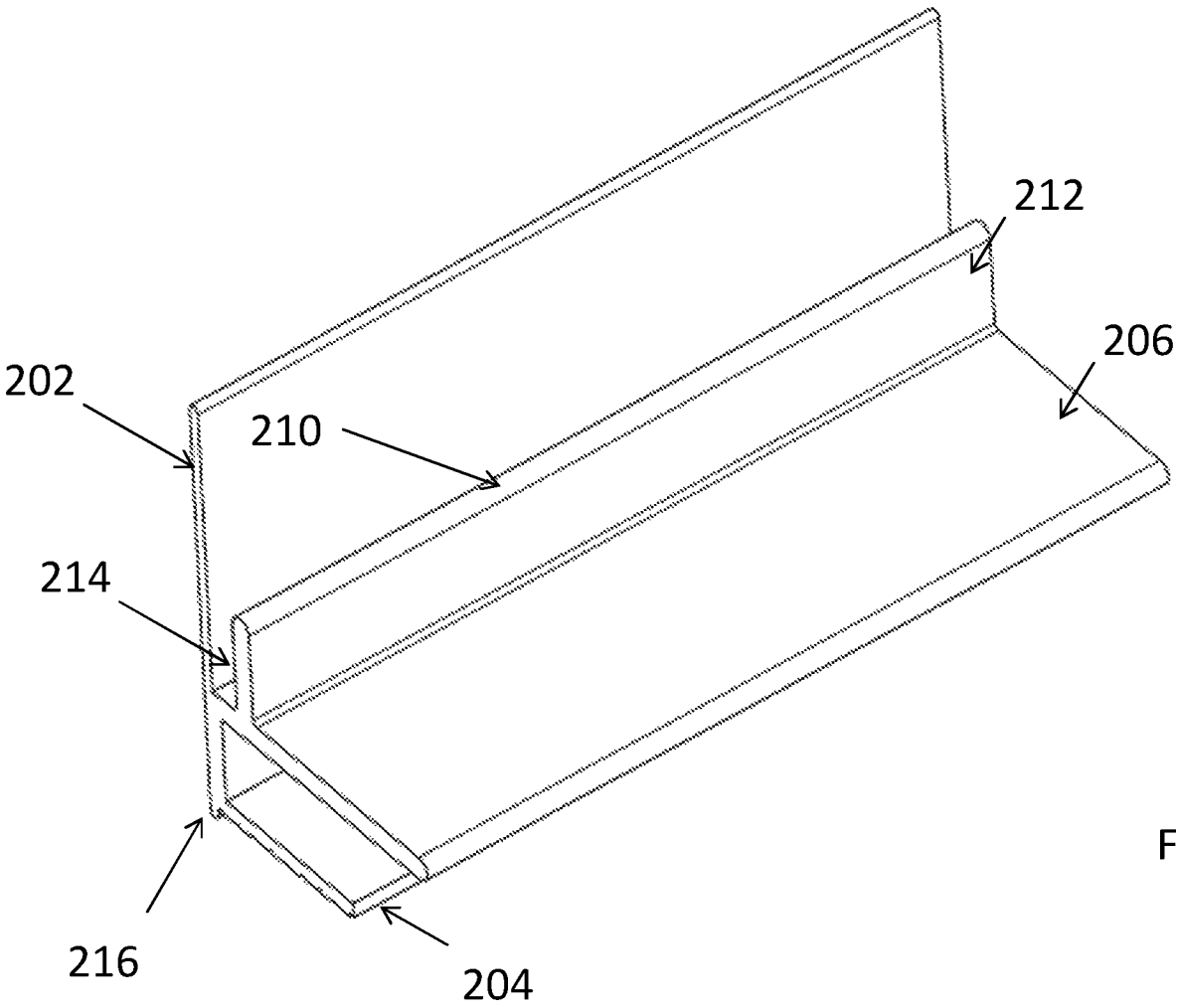
FIG. 4 is a perspective view of the light cove cap of FIG. 3.

FIGS. 3-4 show an embodiment of a light cove cap 200. Light cove cap 200 has a first vertical side wall 202, a lower horizontal wall 204, and an upper horizontal wall 206. Vertical wall 202 may downwardly extend as a lip 216 slightly below lower horizontal wall 204 to define a joining compound receiving area 208. Lower and upper horizontal walls 204 and 206 and a bridging portion of vertical wall 202 may define a board receiving area 210. Upper horizontal wall 206 may extend further away from horizontal wall 202 than lower horizontal wall 204.

A second vertical wall 212 may extend from upper horizontal wall 206 to define a corner key insertion recess 214. As discussed in more detail below, corner key insertion recess 214 can receive corner keys and adhesive to connect adjacent pieces of cap 200.

Prior to installation, the cap 200 has a particular length with ends of shapes as either manufactured or trimmed post manufacture. In the most basic example, cap 200 is already at the perfect length and shape for the area of interest and no trimming is necessary. More likely the area of interest will be longer or shorter than a cap 200. If shorter, cap 200 may be trimmed to size. If longer, additional caps 200 (some of which may have already been cut to size) can be installed next to each other and connected by corner keys inserted into corner key connection recess 214. When adjacent pieces of cap 200 need to connect at different angles, the ends can be trimmed to mating angles as discussed below.

Figure 1:
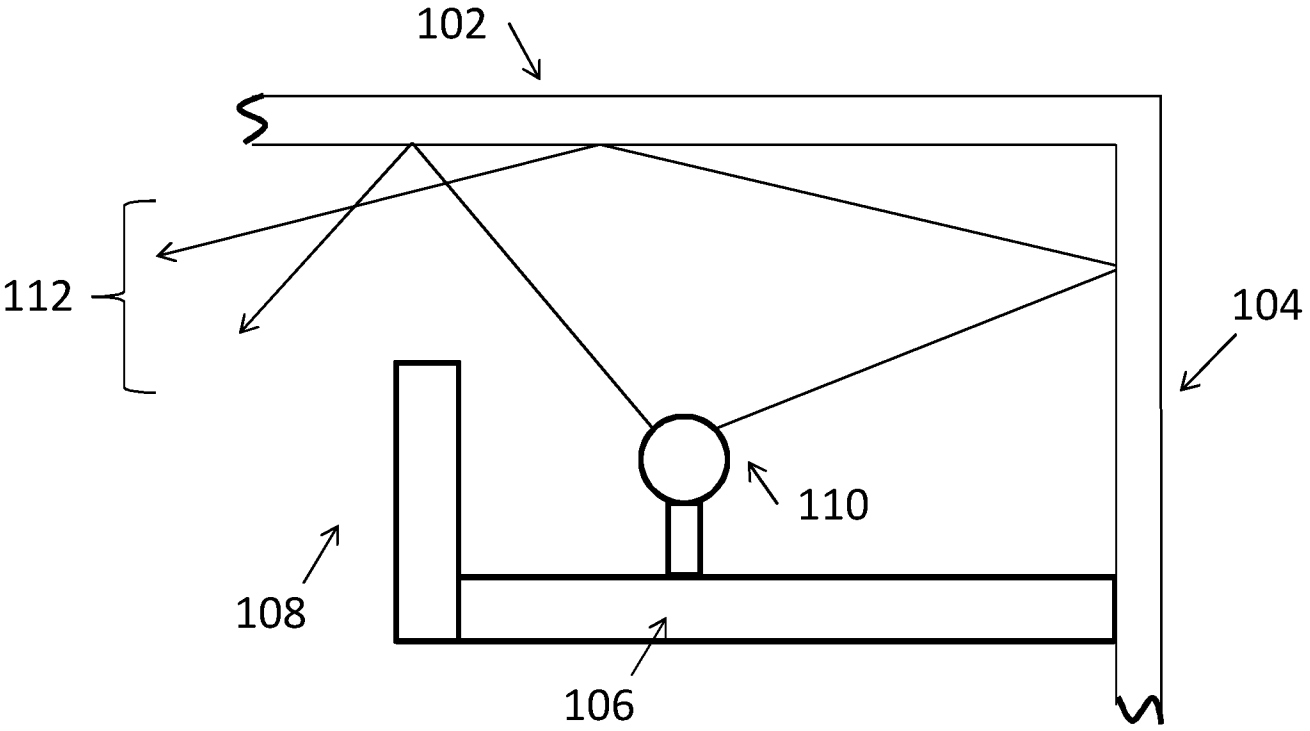
Fig. 1 Prior Art
FIGS. 1 and 2 are cross sections of prior art light coves.
Figure 2:
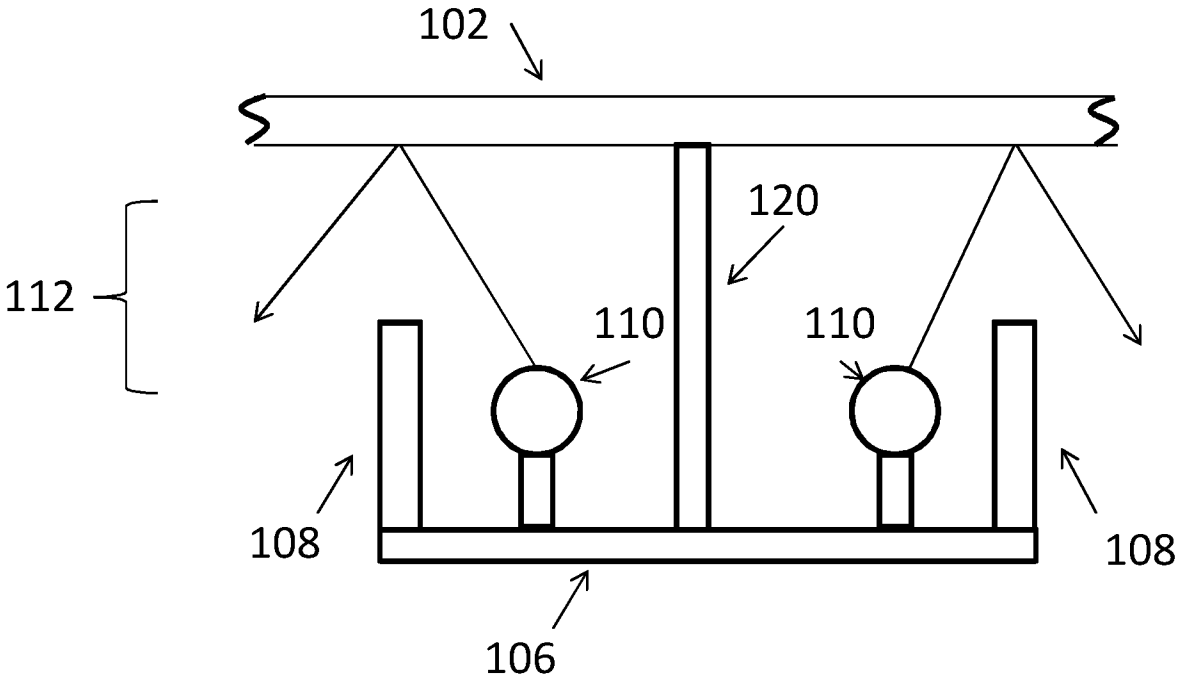
Fig. 2 Prior Art
Figure 5:
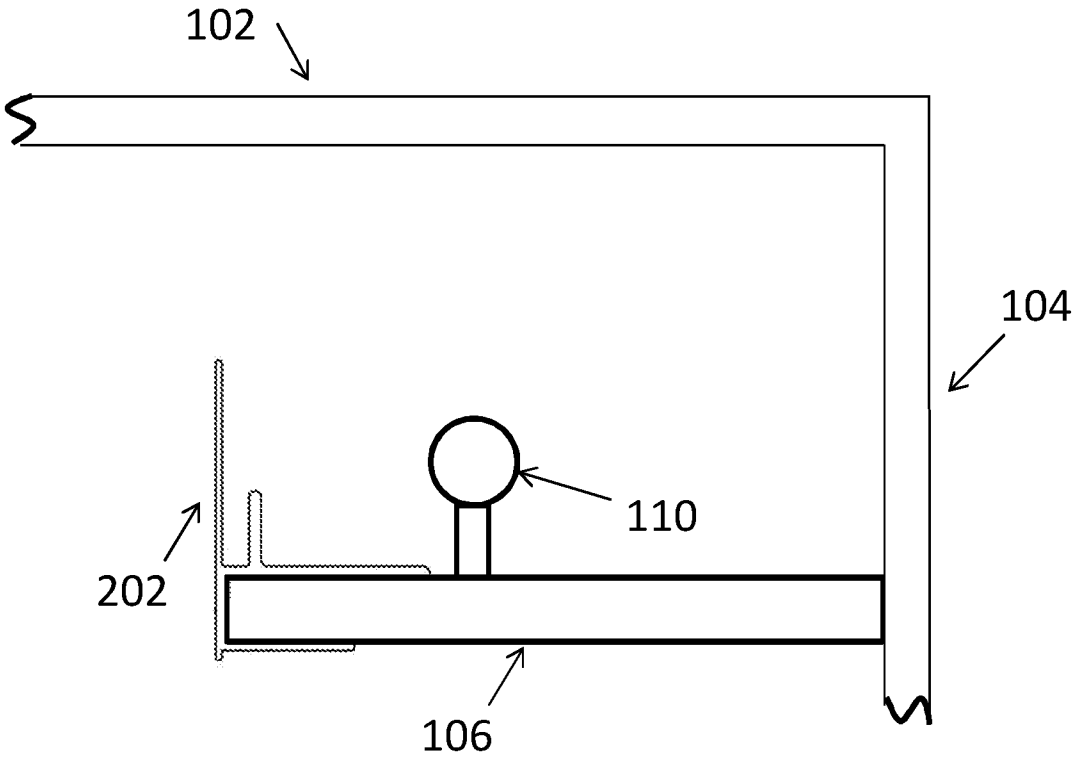
FIGS. 5, 6 and 9 show the embodiment of FIG. 3 in partially mounted states.

FIG. 5 shows cap 200 mounted as a light cove in the environment of FIG. 1. Horizontal board 106 inserts into drywall receiving area 210. In this manner cap 200 acts as an end cap on horizontal board 106, and vertical board 108 from the prior art is eliminated. Light source 110 can be mounted on board 106 as shown, and/or mounted in whole or in part on horizontal wall 206.

Figure 6:
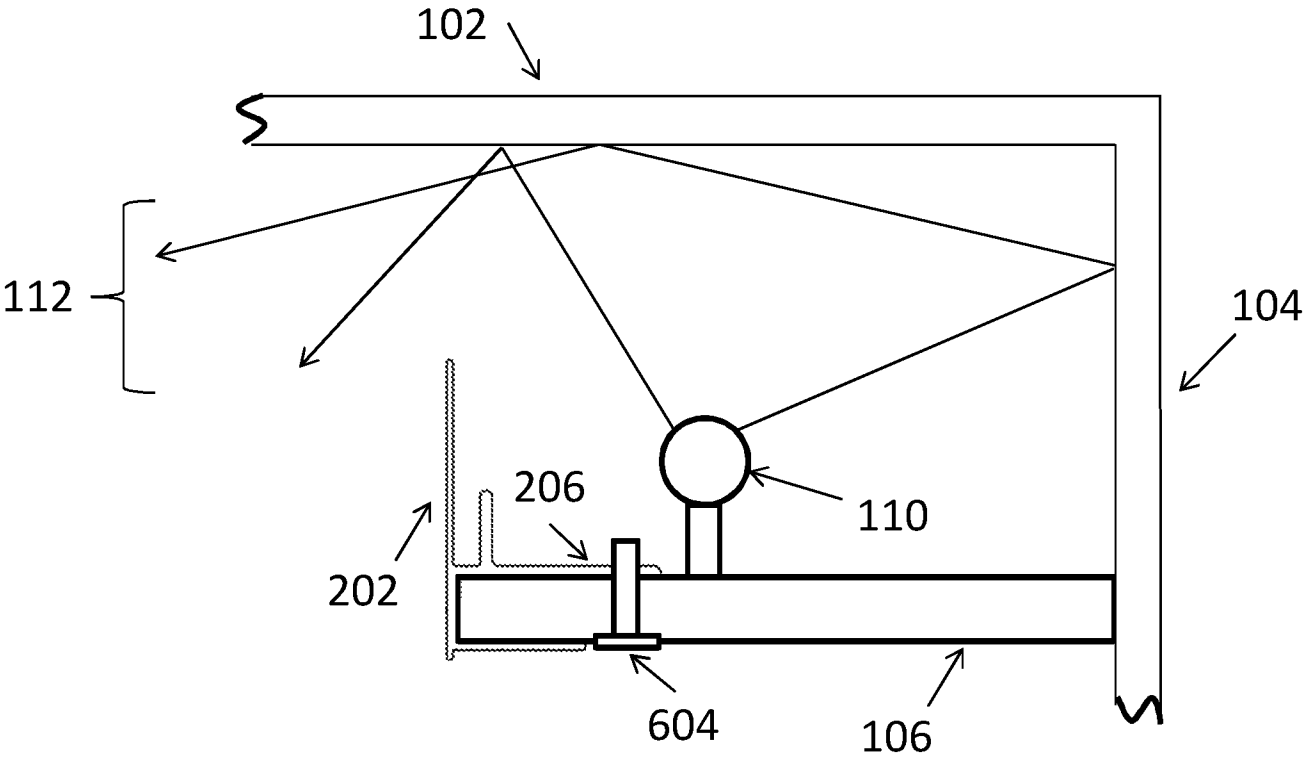

FIG. 6 shows secure installation by one or more screws 604 inserted inward of lower horizontal wall 204, and thus extends only through horizontal board 106 and horizontal wall 206 to secure cap 200 in place. However, the invention is not so limited, and screw(s) 604 could be inserted through both horizontal walls 204 and 206.

Figure 7:
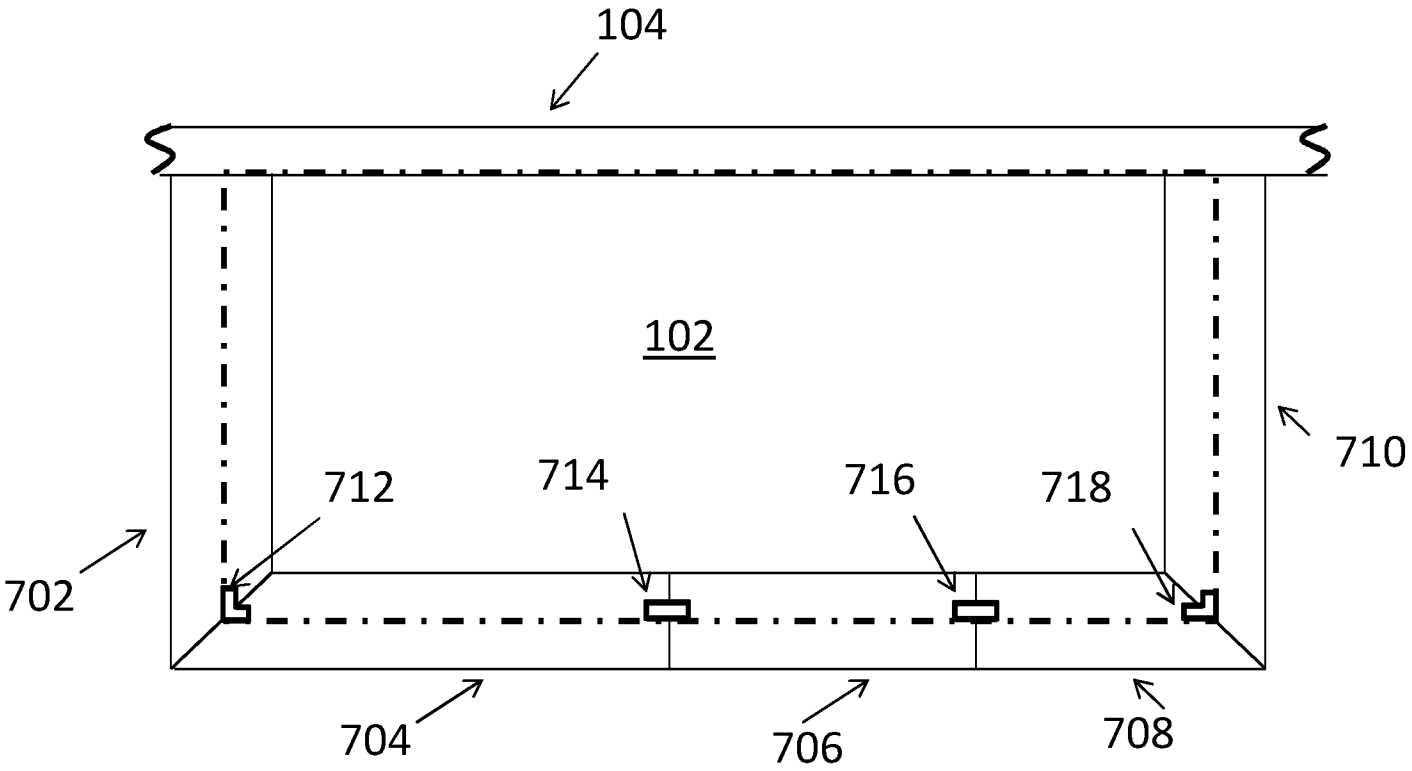
FIGS. 7 and 8 are top views of joined light cove caps.

FIG. 7 shows a non-limiting example of multiple caps 200 connected to form three sides of a rectangular light cove relative to a wall 104 and board 106. On the left side a cap 702 is available of suitable length, and the edge is cut to diagonal to facilitate the transition at the corner. Adjacent at the bottom of FIG. 7 is another cap 704 which is cut at its edge along a diagonal to mate with cap 702, and for which a corner key (in this case with an L-shape) 712 is inserted into the corner key recess. Cap 704 is not long enough for the length of the board 106, and thus another cap 706 will be placed adjacent thereto and connected by a rectangular corner key 714. The combination of caps 704 and 706 is still not long enough for the wall, and thus another cap 708 will be added adjacent thereto with a rectangular corner key 716 on one end, while the opposite end will be trimmed to a diagonal to facilitate the corner transition. A final cap 708 with a diagonal mating edge and an L-shaped corner key 718 completes the frame. The various caps are preferably measured and cut before attachment to board 106.

Figure 8:
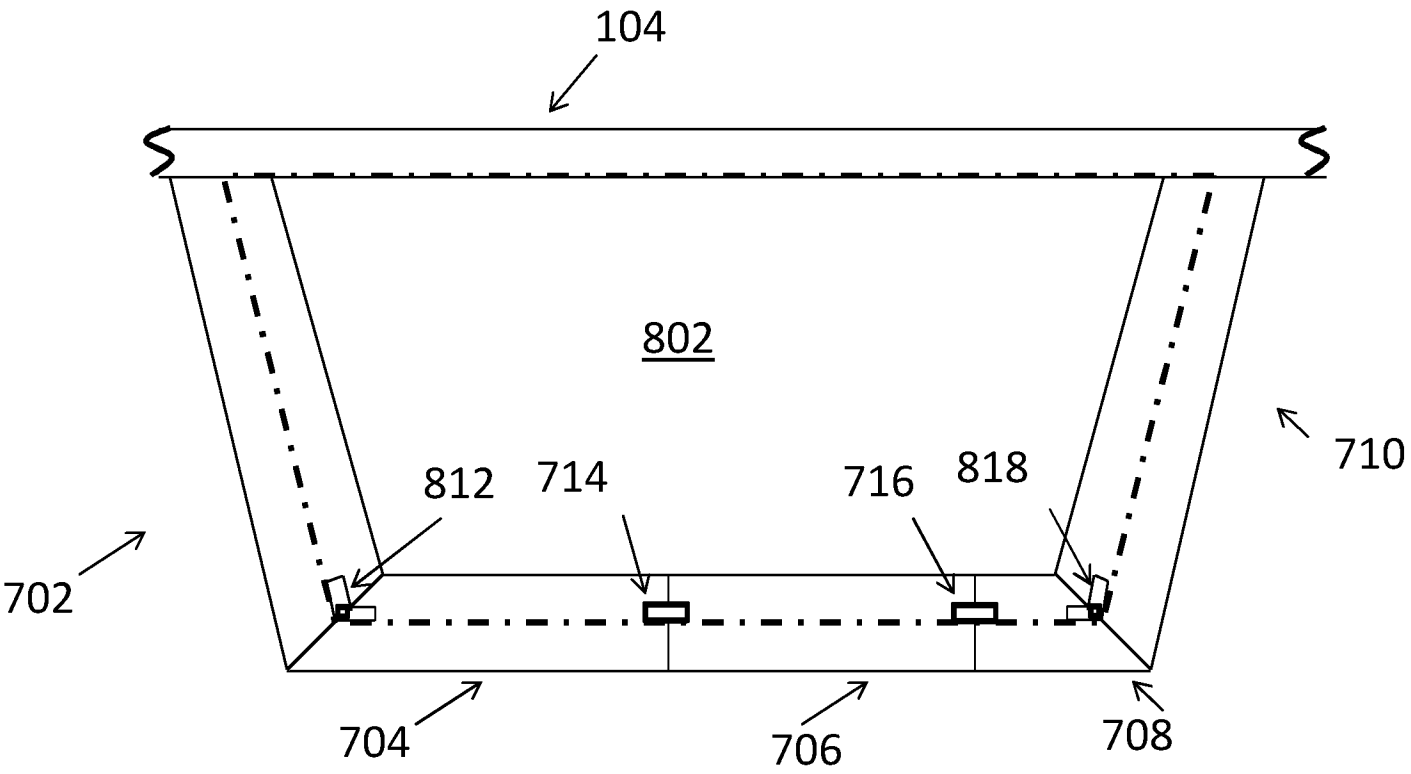

Embodiments herein are not limited to any particular shape of board 106 and/or the light cove overall. By way of non-limiting example, FIG. 8 shows a trapezoid shaped board 802. The various caps are simply trimmed to mating shapes, and angled corner keys (812 and 818 in FIG. 8) of appropriate angle are used where needed.

Figure 9:
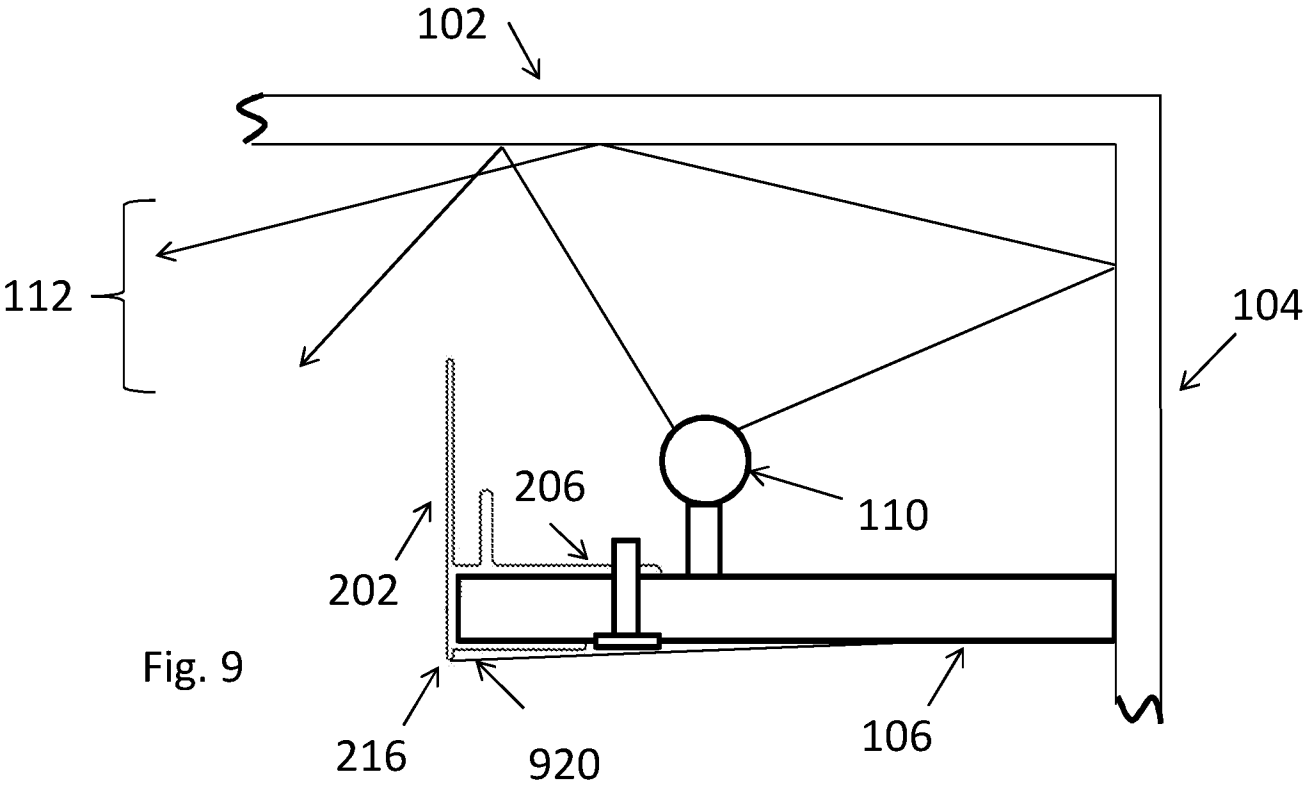

Referring to FIG. 9, once the various caps are mounted and screwed into place, mud and/or tape 920 is applied over joint compound receiving area as is known in the art to form a smooth outer facing finish over the vertical wall 204 and the board 106, and for which the bottom lip of horizontal wall 202 forms a sharp edge that forms a clean, modern look. The underside may be painted or otherwise decorated as desired. Outer wall 202 may be left as is to provide a metal exterior, painted or otherwise decorated.

Use of cap 200 eliminates the labor and materials needed to frame the ends of the light cove. The design also has sharp clean lines as desirable for modern décor.

Figure 10:
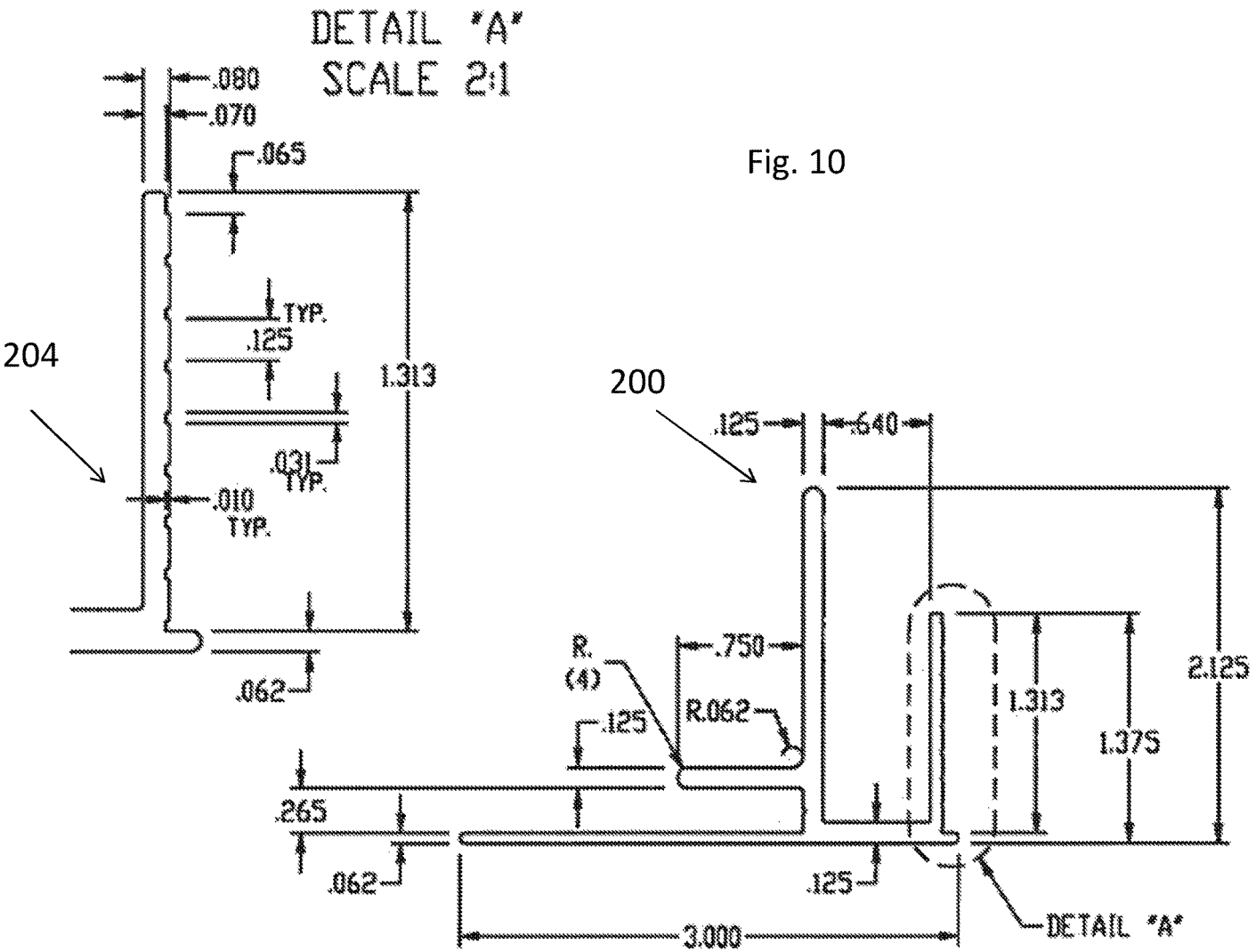
FIGS. 10 and 11 are to scale cross section of the embodiment of FIG. 3 with non-limiting examples of cap dimensions.
Figure 11:
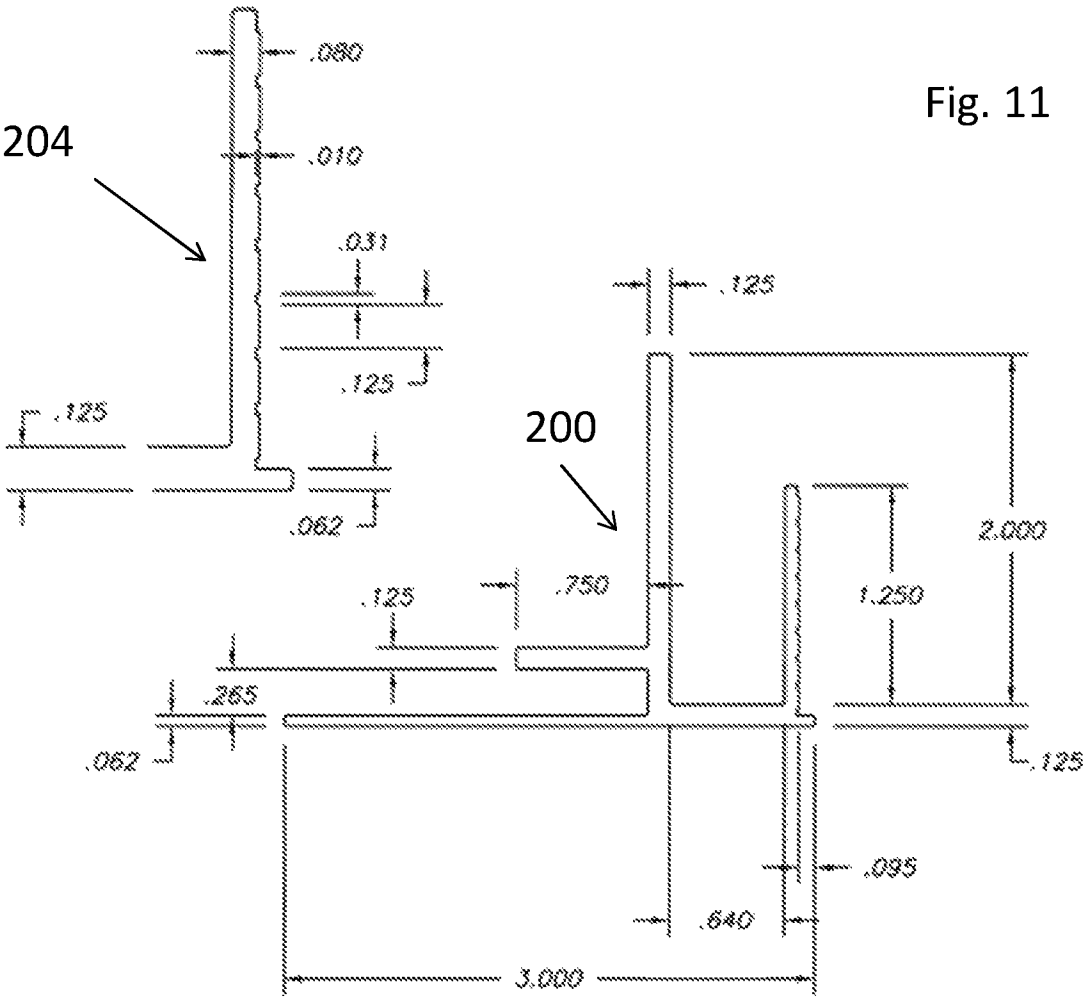

FIGS. 10 and 11 show non-limiting examples of cap 200 with possible dimensions.

Various modifications to such dimensions can be made as desired. By way of non-limiting example, wall 202 could be higher to create a higher light cove barrier. By way of another example, gap 210 could be larger or smaller to accommodate boards 106 of different thickness.

Wall 1202 in the above embodiment creates the shape of the outer appearance of the light cove, in this case flat and vertical. However, the invention is not so limited, and other shapes, and combinations of shapes, may be used.

Figure 12:
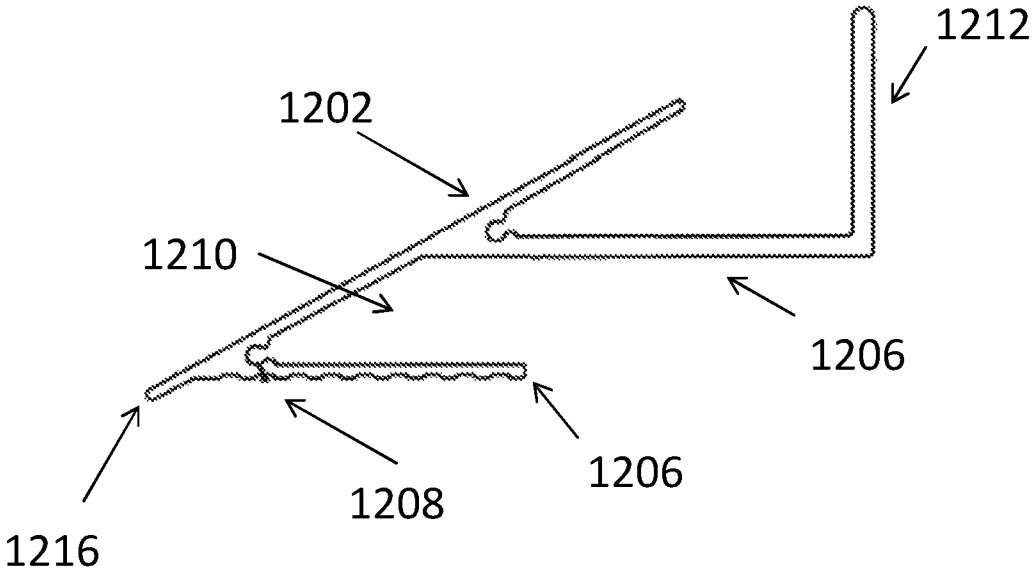
FIG. 12 is a cross section of a light cove cap according to an embodiment of the invention.
Figure 15:
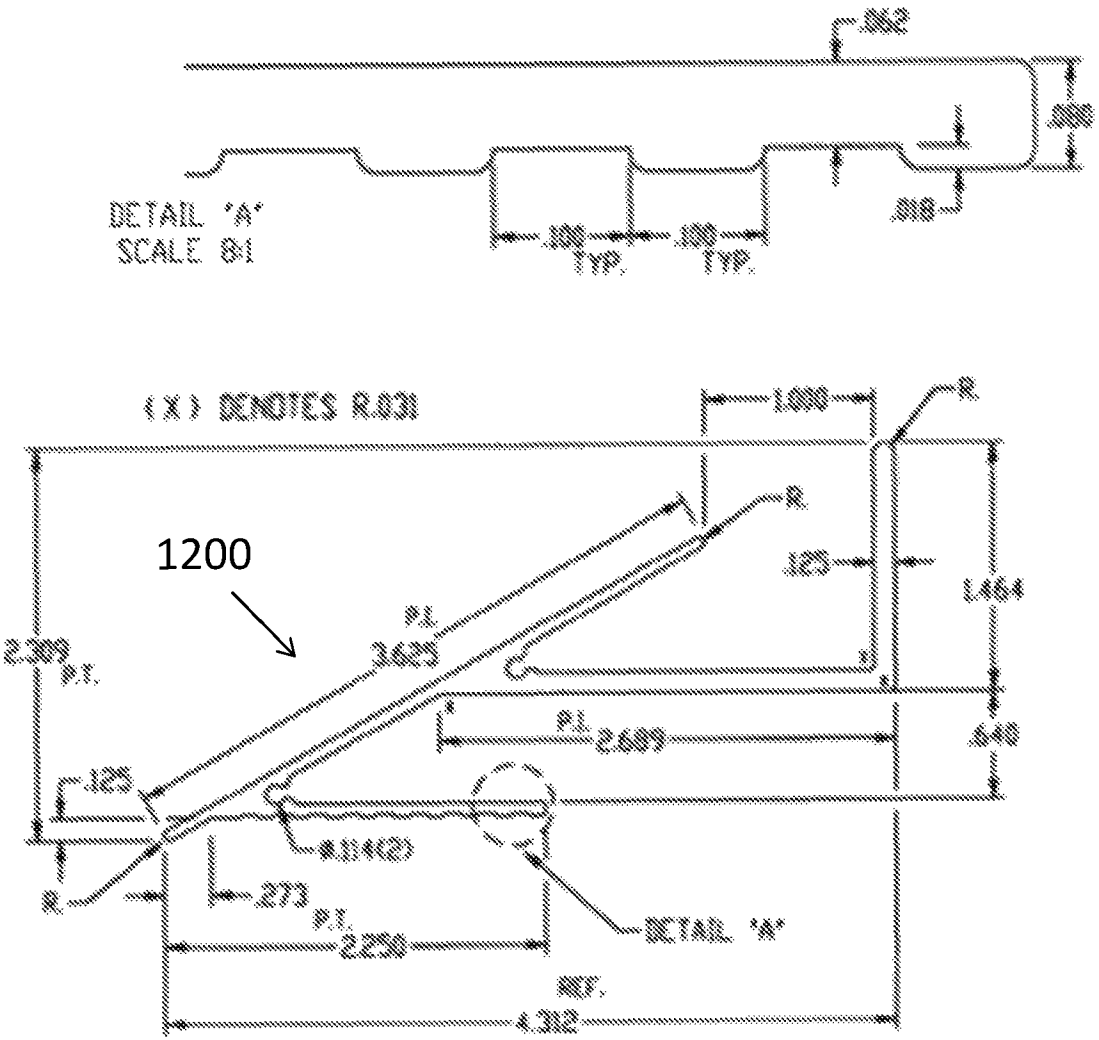
FIG. 15 shows a to scale cross section of the embodiment of FIG. 12.

By way of non-limiting example, FIG. 12 shows an embodiment of a light cove cap 1200 in which a 60 degree angle is provided, although the invention is not so limited and any desired angle could be used. FIG. 15 shows a non-limiting example of cap 1200 with specific dimensions.

Light cove cap 200 has a diagonal side wall 1202, a lower horizontal wall 1204, and an upper horizontal wall 1206. Diagonal wall 1202 may extend as a lip 1216 slightly below lower horizontal wall 1204 to define a joining compound receiving area 1208. Lower and upper horizontal walls 1204 and 1206 and a bridging portion of diagonal wall 1202 may define a drywall receiving area 1210. Upper horizontal wall 1206 may extend further away from diagonal wall 1202 than lower horizontal wall 1204.

A second vertical wall 1212 may extend from upper horizontal wall 1206 to define a light barrier. In the alternative, wall 1212 may be removed and diagonal wall 1210 may act as the light barrier.

Figure 13:
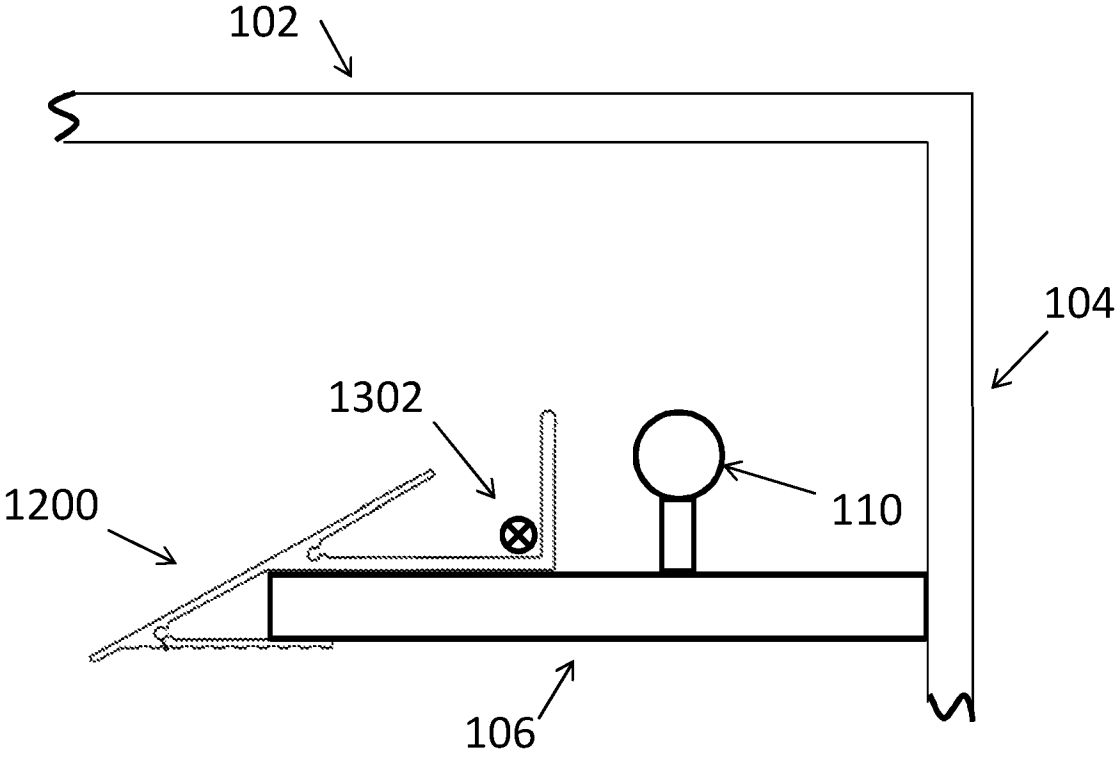
FIGS. 13 and 14 show the embodiment of FIG. 12 in partially mounted states.
Figure 14:
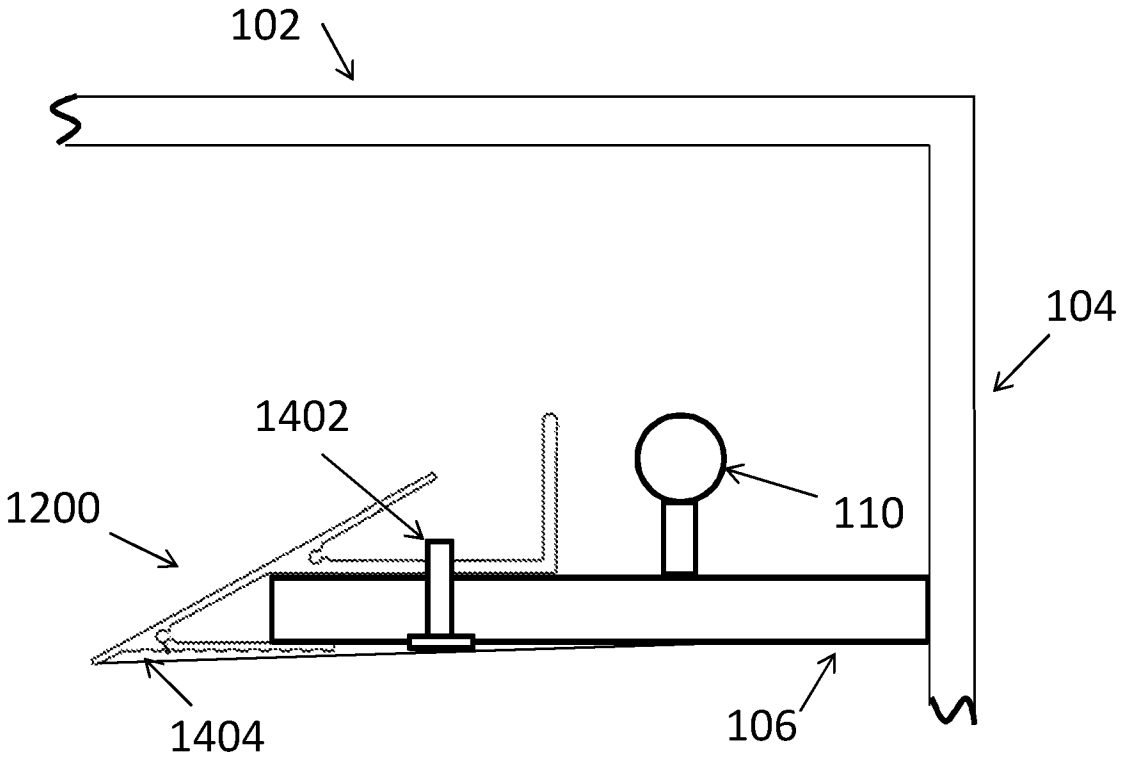

Referring now to FIGS. 13 and 14, cap 1200 is mounted on board 106 in the same manner as cap 200, i.e., via screws 1402 and mud/tape 1404. Light source 110 can be mounted on board 106, for which portions of cap 1200 will act as a light barrier. In additional and/or the alternative, a light source 1302 may be mounted on upper horizontal wall 1206. Light source 1302 is illustrated as smaller than 110 to indicate that light source 1302 preferably does not extend above the top of diagonal wall 1202, but this need not be the case and either light source may be smaller or larger than that shown.

Figure 16:
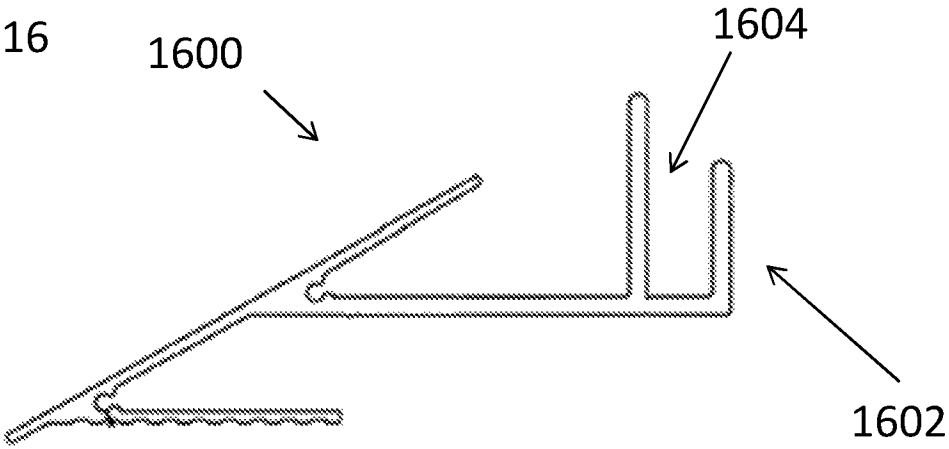
FIG. 16 is a cross section of another embodiment of the invention.

Referring now to FIG. 16, another embodiment of an angled light cove cap 1500 is shown. In this embodiment, another vertical wall 1602 combined with vertical wall 1212 and a portion of horizontal wall 1206 to define a key insertion recess 1604 to receive a corner key as described above.

Figure 17:
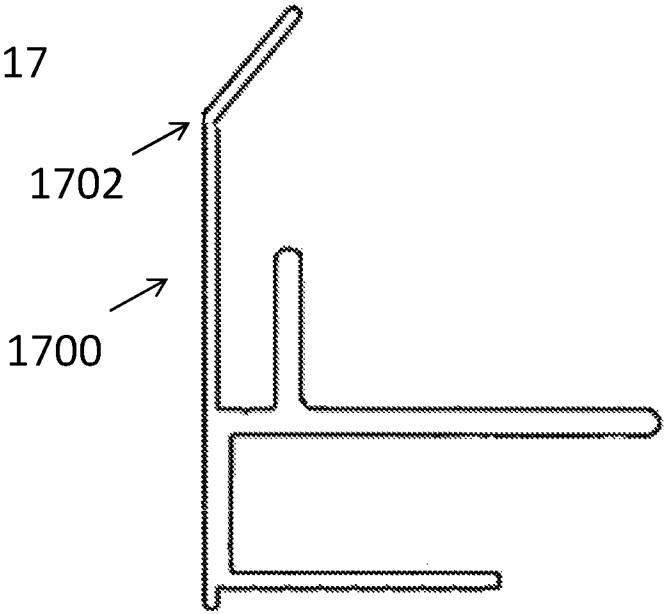
FIG. 17 is a cross section of another embodiment of the invention.

Referring now to FIG. 17, another embodiment of the invention is shown. A light cove cap 1700 has a side wall 1702 that is partially straight and partially angled to create a beveled appearance. Installation may be the same as discussed with respect to cap 200.

Figure 18:
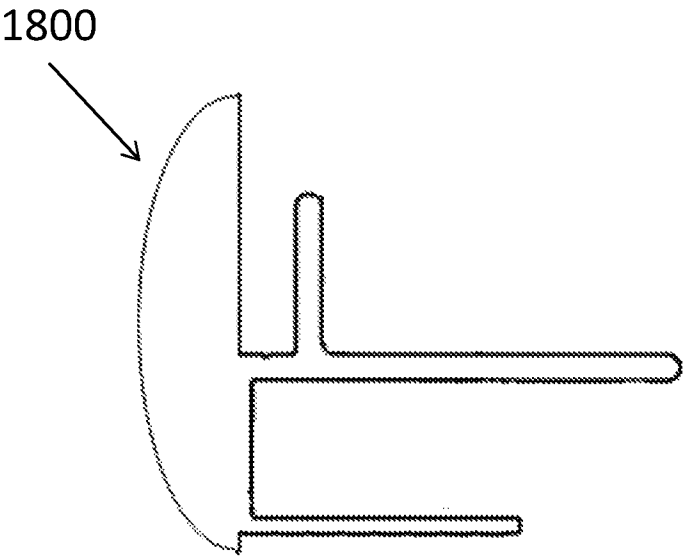
FIG. 18 is a cross section of another embodiment of the invention.

Referring now to FIG. 18, another embodiment of the invention is shown. A light cove cap 1800 has a side wall 1802 that is curved. Installation may be the same as discussed with respect to cap 200.

Figure 19:
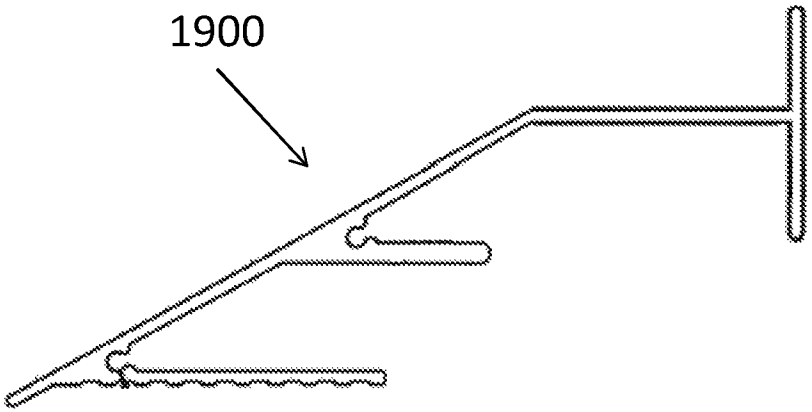
FIG. 19 is a cross section of another embodiment of the invention.

Referring now to FIG. 19, another embodiment of the invention is shown. A light cove cap 1900 has T-shaped extension at the end of diagonal wall 1202. Installation may be the same as discussed with respect to cap 200.

Figure 20:
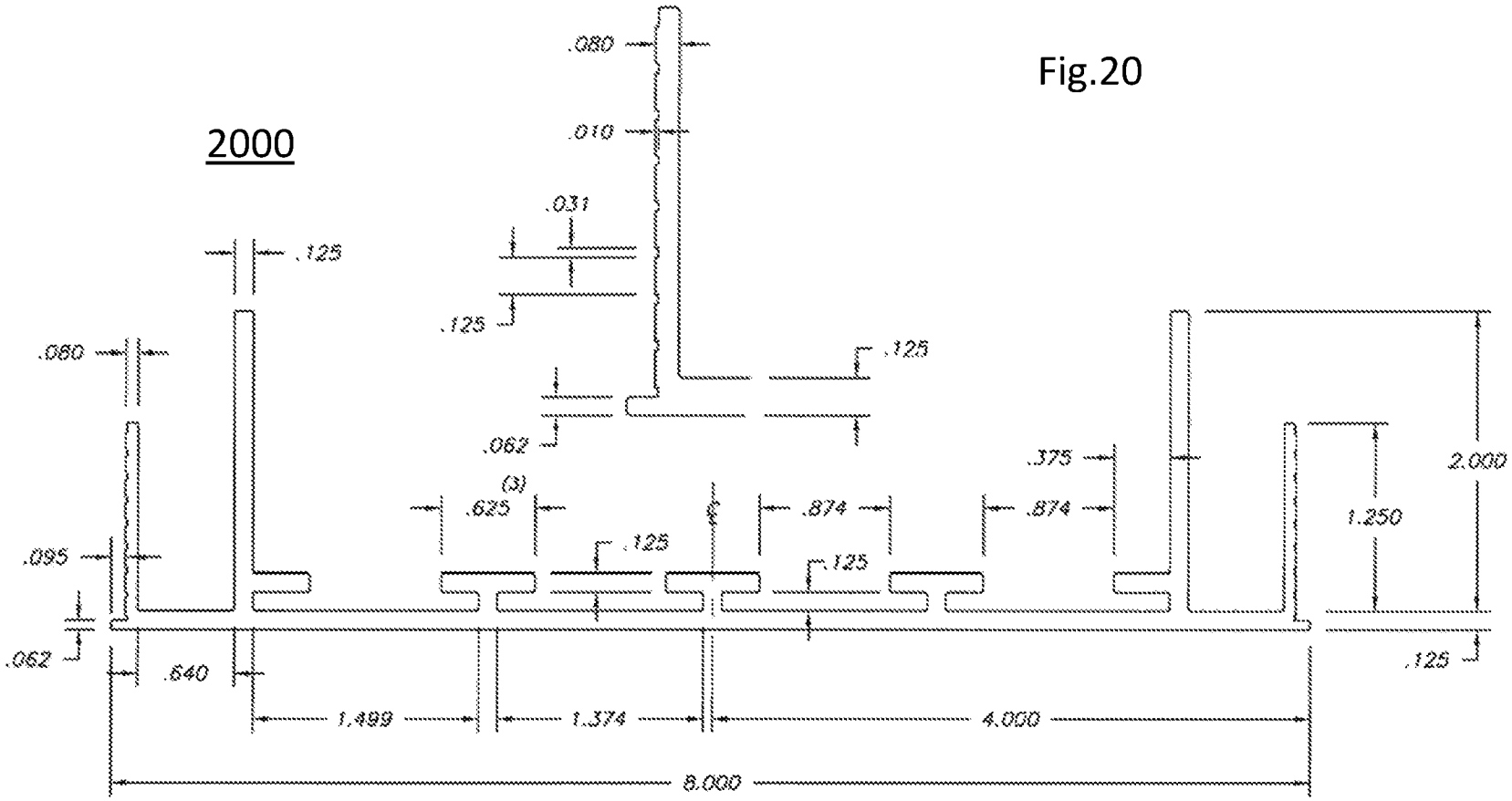
FIG. 20 is a cross section of another embodiment of the invention.

Referring now to FIG. 20, another embodiment of the invention is shown along with a non-limiting example of dimensions. A light cove cap 2000 is similar to 200, save that it is symmetrical and can mount to two different boards 106. The board receiving areas are shown with the same width, but this need not be the case and different widths could be provided for board 106 of different thickness.

Embodiments of the caps may be made from extruded aluminum. However, other materials could be used, such as by way of non-limiting example metal or plastic.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A light cove cap, comprising:

a first wall;

a second wall extending from the first wall;

a third wall extending from the first wall below the second wall and substantially parallel to the first wall;

the second wall, the third wall, and a bridging portion of the first wall defining a board receiving area;

the first wall extending below the third wall, wherein the third wall and portion of the first wall extending below the third wall defines a drywall compound receiving area, wherein the second wall extends further from the first wall than the third wall;

wherein the cap is adapted to be mounted on a board by:

inserting the board receiving areas over a board;

attaching at least the board and the second wall;

applying drywall compound over the drywall receiving area and an adjacent portion of the board.

2. The cap of claim 1, wherein the first wall is a substantially perpendicular to the second and third walls.

3. The cap of claim 1, further comprising a fourth wall extending from the second wall, wherein the first wall, the fourth wall, and a bridging portion of the second wall define a corner key receiving area adapted to receive a corner key to connect adjacent caps.

4. The cap of claim 3, wherein the fourth wall is substantially parallel to the first wall.

5. The cap of claim 1, wherein the attaching comprises inserting a connector through the board and the second wall but not the third wall, and the applying covers an exposed portion of the connector.

6. The cap of claim 1, wherein the first wall is at a diagonal to the second and third walls.

7. The cap of claim 6, wherein the end of the second wall is offset laterally from the end of the third wall.

8. The cap of claim 6, wherein the attaching comprises inserting a connector through the board and the second wall but not the third wall, and the applying covers an exposed portion of the connector.

9. The cap of claim 6, further comprising a fifth wall extending from the second wall to a height above the top of the first wall.

10. A light cove, comprising:

a board connected to a wall or ceiling;

a light cap, comprising:

a first wall;

a second wall extending from the first wall;

a third wall extending from the first wall below the second wall and substantially parallel to the first wall;

the second wall, the third wall, and a bridging portion of the first wall defining a board receiving area that receives the board;

the first wall extending below the third wall, wherein the third wall and portion of the first wall extending below the third wall defines a drywall compound receiving area, wherein the second wall extends further from the first wall than the third wall;

at least one connector connecting at least the second wall and the board;

drywall compound covering the drywall compound receiving area, an adjacent portion of the board, and an exposed portion of the connector.

11. The cap of claim 10, wherein the first wall is a substantially perpendicular to the second and third walls.

12. The cap of claim 10, further comprising a fourth wall extending from the second wall, wherein the first wall, the fourth wall, and a bridging portion of the second wall define a corner key receiving area adapted to receive a corner key to connect adjacent caps.

13. The cap of claim 12, wherein the fourth wall is substantially parallel to the first wall.

14. The cap of claim 13, further comprising a connector inserted through the board and the second wall but not the third wall, and the drywall compound covers an exposed portion of the connector.

15. The cap of claim 10, wherein the first wall is at a diagonal to the second and third walls.

16. The cap of claim 15, wherein the end of the second wall is offset laterally from the end of the third wall.

17. A method for creating a light cove defined in part by a board and a light source, comprising:

providing a cap, the cap comprising:

a first wall;

a second wall extending from the first wall;

a third wall extending from the first wall below the second wall and substantially parallel to the first wall;

the second wall, the third wall, and a bridging portion of the first wall defining a board receiving area;

the first wall extending below the third wall, wherein the third wall and portion of the first wall extending below the third wall defines a drywall compound receiving area, wherein the second wall extends further from the first wall than the third wall;

inserting the board receiving area over a board;

attaching at least the board and the second wall;

applying drywall compound over the drywall receiving area and an adjacent portion of the board.

18. The method of claim 17, wherein the attaching comprises inserting a connector through the board and the second wall but not the third wall, and the applying covers an exposed portion of the connector.

* * * * *